US006427806B1

(12) United States Patent
Tanaka

(10) Patent No.: US 6,427,806 B1
(45) Date of Patent: Aug. 6, 2002

(54) FOOD AND DRINK CONVEYING SYSTEM

(75) Inventor: Kunihiko Tanaka, Sakai (JP)

(73) Assignee: Kura Corporation, Ltd., Osaka (JP)

( * ) Notice: Subject to any disclaimer, the term of this patent is extended or adjusted under 35 U.S.C. 154(b) by 27 days.

(21) Appl. No.: 09/635,010

(22) Filed: Aug. 9, 2000

(30) Foreign Application Priority Data

Aug. 12, 1999 (JP) ..... 11-228582

(51) Int. Cl.[7] ..... E04H 3/04
(52) U.S. Cl. ..... 186/49
(58) Field of Search ..... 186/49, 50, 3, 186/26, 35, 47; 198/349; 705/15

(56) References Cited

U.S. PATENT DOCUMENTS 1,330,890 A * 2/1920 Mayne
3,876,038 A * 4/1975 Riller et al. ..... 186/1 B
4,349,086 A * 9/1982 Yamada ..... 186/49
6,145,628 A * 11/2000 Tanaka ..... 186/50
6,179,088 B1 * 1/2001 Lai ..... 186/49

* cited by examiner

*Primary Examiner*—Donald P. Walsh
*Assistant Examiner*—Mark J Beauchaine
(74) *Attorney, Agent, or Firm*—Frishauf, Holtz, Goodman, Langer & Chick, P.C.

(57) ABSTRACT

A conveying container includes an input means for inputting a specified table number, a food and drink detecting means for detecting presence of the food and drink in the container, a conveying-container-side transmitter for sending out information that is output from the input means and the food and drink detecting means, a conveying-container-side receiver for receiving specified information, and an operation control means for controlling operation of the guide means on the basis of the input from the input means, while on the other hand, a conveying path side of the food and drink conveying system includes a conveying-path-side receiver for receiving signals output from the conveying-container-side transmitter, a conveying-path-side transmitter for sending out signals associated with the respective tables to the conveying-container-side receiver, a controller for controlling the conveying-path-side receiver and the conveying-path-side transmitter, and a monitor for informing someone of a variety of information.

4 Claims, 6 Drawing Sheets

| TABLE NO. | NAME OF ARTICLE |
|---|---|
| C | TUNA |
| F | SQUID |
| G | *AKAMISO* SOUP |
| | |
| | |

FOOD AND DRINK CONVEYING SYSTEM

BACKGROUND OF THE INVENTION

1. Field of the Invention

The present invention relates to a food and drink conveying system, set in a sushi bar and a like eating place, for making a circulation of e.g. dished-up sushi by means of a conveying path so that customers can take the circulating foods and drinks at their own choice.

2. Description of the Prior Art

In recent years, there have been increasing sushi bars and like eating places that introduce a food and drink conveying system having a conveying path that circulates along lots of tables or counters set in the sushi bar and like eating place. Foods (e.g. sushi) and drinks dished up on plates are served to the conveying path as occasion calls so that customers at the tables can take and eat a variety of foods and drinks passing in order through the conveying path at their own choice.

In this food and drink conveying system, the foods and drinks dished up on the plates are usually served to the conveying path as occasion calls, irrespective of the customers' liking, but sometimes are served to meet the customers' orders.

When ordering, the customer must pay attention to the conveyance of his/her order, but sometimes overlooks his/her order passing past him/her. In that case, the orderer must wait until his/her order is re-circulated through the conveying path before him/her and, what is worse, another person sometimes takes that order away without knowing it before reaching the orderer. Due to this, the orderer sometimes makes a complaint, "what happened to my order".

In consideration of this circumstance, the present invention has been developed. It is the object of the invention to provide a food and drink conveying system that can prevent an ordered food or drink served to and conveyed through a conveying path from being taken out by another person by mistake and also can manage on whether the ordered food or drink is duly taken by the orderer.

SUMMARY OF THE INVENTION

To achieve the object above, the present invention provides a food and drink conveying system comprising a circulating conveying path for food and drink; a plurality of tables arranged along the conveying path; a conveying container to contain an ordered food or drink therein and to be placed on the circulating conveying path; and a guide means for giving an orderer a notice of an arrival of his/her order contained in the conveying container, wherein a conveying container side of the food and drink conveying system comprises an input means for inputting a specified table number, a food and drink detecting means for detecting presence of the food and drink in the container, a conveying-container-side transmitter for sending out information that is output from the input means and the food and drink detecting means, a conveying-container-side receiver for receiving specified information, and an operation control means for controlling operation of the guide means on the basis of the input from the input means, while on the other hand, a conveying path side of the food and drink conveying system comprises a conveying-path-side receiver for receiving signals output from the conveying-container-side transmitter, a conveying-path-side transmitter for sending out signals associated with the respective tables to the conveying-container-side receiver, a controller for controlling the conveying-path-side receiver and the conveying-path-side transmitter, and a display means for displaying a variety of information, so that, after the conveying container containing the food or drink therein arrived at the specified table having the table number input by the input means, the information, detected by the detecting means, on the presence of the food or drink to be taken out from the conveying container is sent out from the conveying-container-side transmitter to the conveying-path-side receiver to display the information on the display means through the controller.

This construction can provide the result that when the ordered food or drink is conveyed by means of the circulating conveying path, the orderer can be informed of the arrival of the ordered food or drink by the guide means near the orderer's table, so that the orderer can surely take the ordered food or drink without being taken away by another person by mistake and, in addition to this, the management can be made on whether the ordered food or drink was duly taken by the orderer.

Further, the food and drink conveying system is preferably provided with a take-away device for the conveying container from which the food or drink was taken out to be taken away from the circulating conveying path. This arrangement enables the conveying container sent along the orderer to be withdrawn.

Further, it is preferable that in the food and drink conveying system, the sending and receiving of the signals between the transmitters and their respective receivers is performed by use of infrared light. This can provide the result of preventing crossing of the transmission that can be caused by the use of radio waves, for example.

DETAILED DESCRIPTION OF THE EMBODIMENTS

Referring now to the accompanying drawings, an example of the preferred embodiment of the present invention directed to a food and drink conveying system will be described below. It is to be understood, however, that the scope of the invention is by no means limited to the illustrated embodiments.

Figure 1:
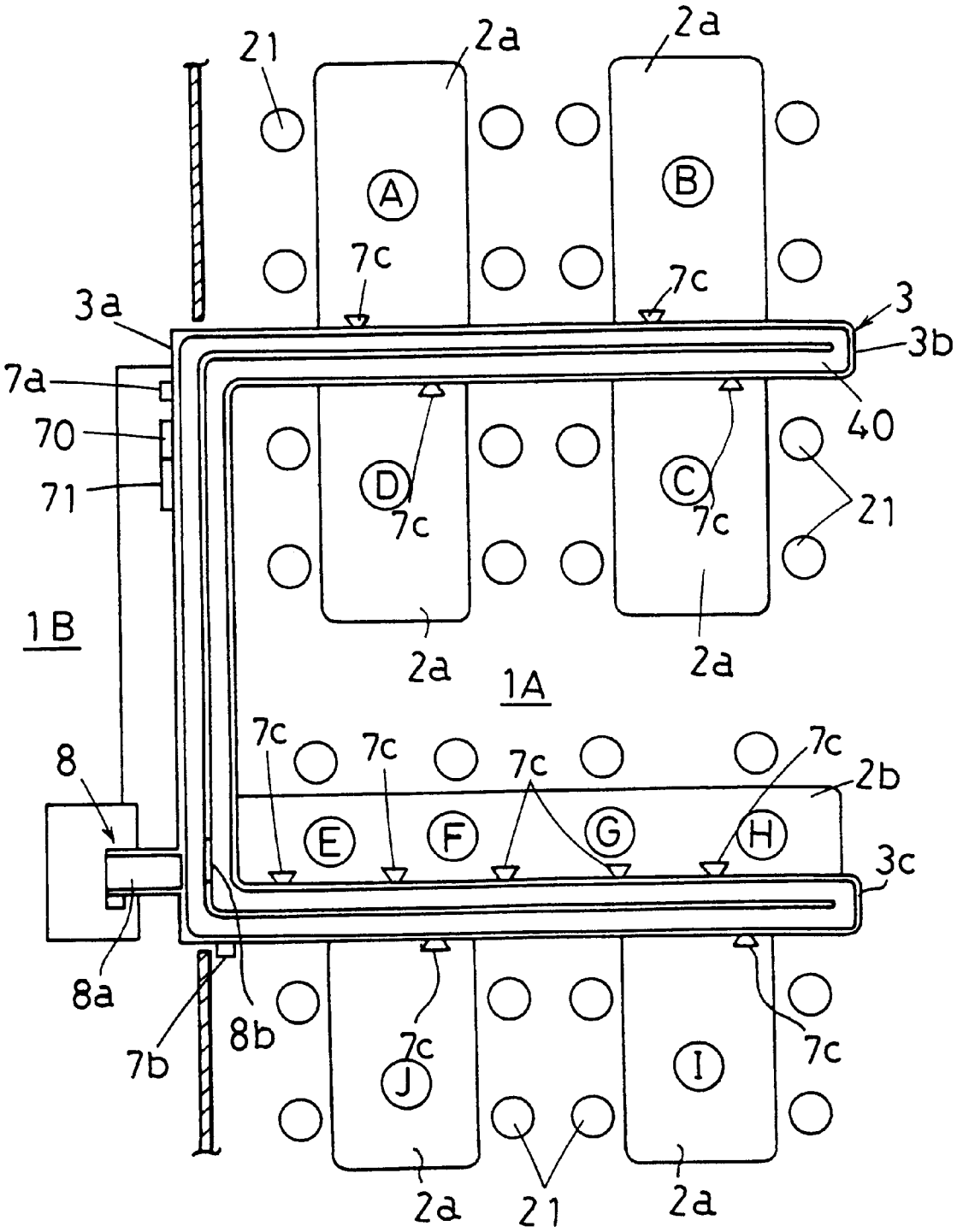
FIG. 1 is a schematic plan view of an interior of an eating house in which a food and drink conveying system of the invention is set.

Referring to FIG. 1, there is shown an interior of a sushi bar as viewed from top in which there are provided a plurality of tables 2*a* and a counter 2*b* set in a dinning area 1A; a compartment housing 3 arranged along a front side of a kitchen 1B and along the tables and counter 2*a*, 2*b*; and a food and drink conveying system 4 having a circulating conveying path 40, circularly arranged on the compartment housing 3, for circularly conveying foods, such as sushi and drinks dished up on plates P in the kitchen 1B.

The compartment housing 3 is formed to have a box shape in section which is formed by spaced apart, opposite, side walls 31, a top wall 32 and a bottom wall (not shown) connecting between the both side walls 31 at upper and lower ends thereof.

The compartment housing 3 comprises a first housing portion 3*a*, arranged along the front side of the kitchen 1B, for separating the kitchen 1B from the dinning area 1A; second and third housing portions 3*b*, 3*c* bending from both lengthwise ends of the first housing portion 3*a* and extending in parallel in the dinning area 1A. The tables 2*a* and the counter 2*b* are arranged alongside of the side walls 31 at the second and third housing portions 3*b*, 3*c*, and chairs 21 are arranged at the tables and the counter 2*a*, 2*b*.

The tables 2*a* and the counter 2*a* are marked with table numbers of (A), (B), (C), (D), (E), (F), (G), (H), (I) and (J), as shown in FIG. 1. The counter 2*b* is marked in association with the individual chairs 21, as illustrated. Hereinafter, the table and counter 2*a*, 2*a* sometimes are simply referred to as the table.

Figure 2:
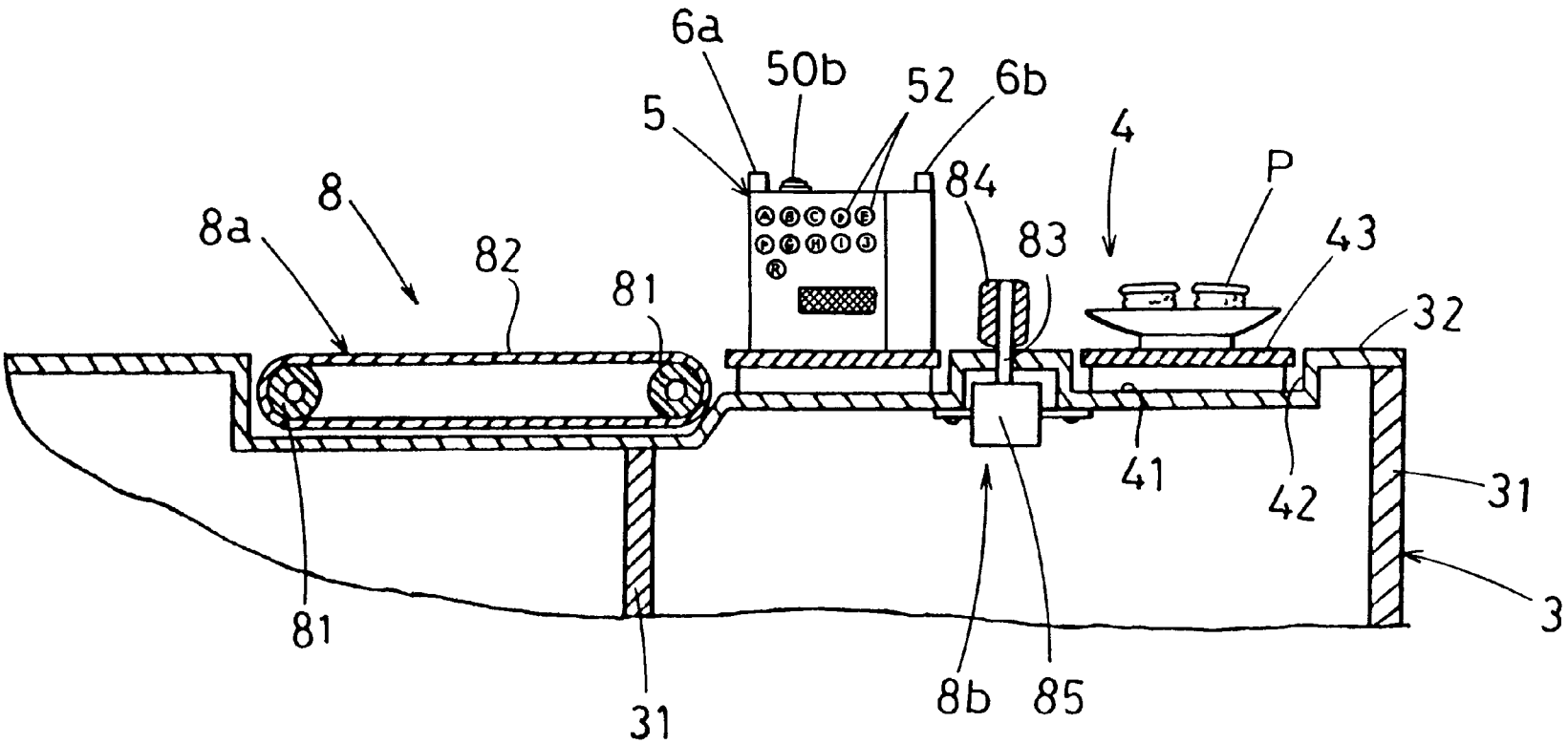
FIG. 2 is an enlarged sectional view of a principal part of the food and drink conveying system.

The conveying path 40 comprises a recess 41 provided in the top wall 32 of the housing portions 3*a*, 3*b* and 3*c*; and a flat endless chain 43 which is moved in circulation in the recess 41 by motor drive while it is guided along guide walls 42 provided at both widthwise sides of the recess 41, as shown in FIG. 2. As shown in FIG. 2, the plates P each putting thereon food or drink are placed directly on the flat chain 43 of the conveying path 40 to convey the plates P in circulation.

The food and drink conveying system 4 above comprises a conveying container 5 to place an ordered food or drink thereon and be placed on the conveying path 40, and a speaker 50*a* and a lamp 50*b* used as noticing means for giving an orderer a notice of an arrival of his/her order placed on the conveying container 5 at a place near the orderer's table 2*a*, 2*b*.

Figure 4:
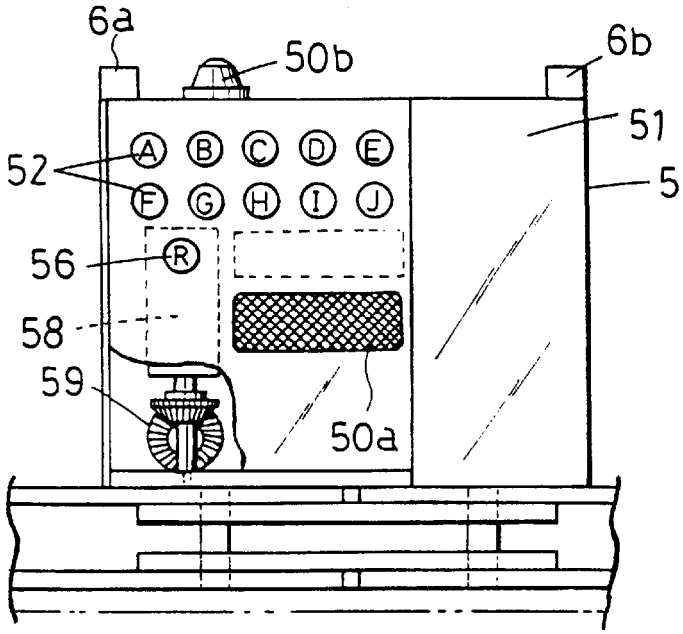
FIG. 4 is a side view of a schematic diagram of a conveying container.
Figure 5:
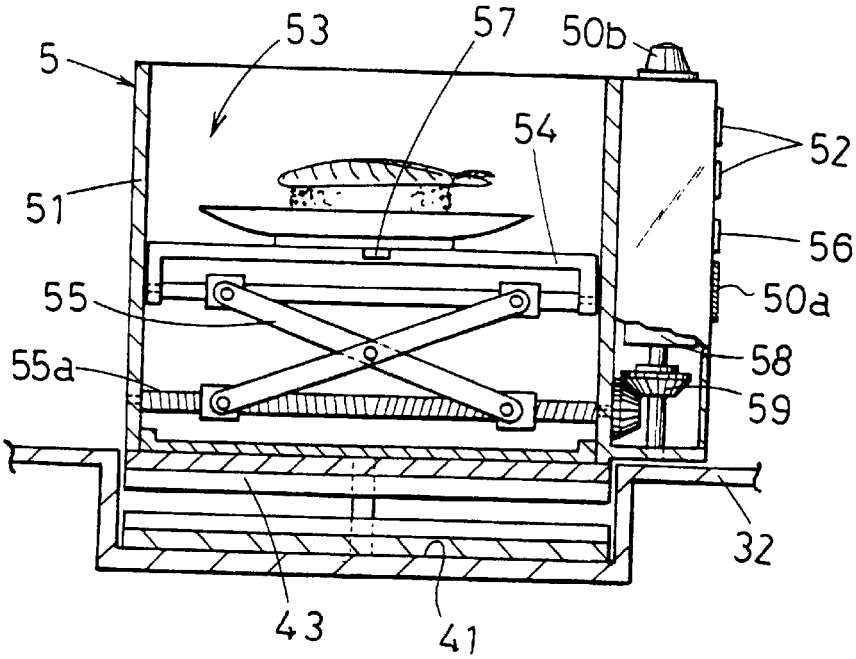
FIG. 5 is a sectional view showing the state in which a plate is retracted in a retracting portion of the conveying container placed on the conveying path of the food and drink conveying system.
Figure 6:
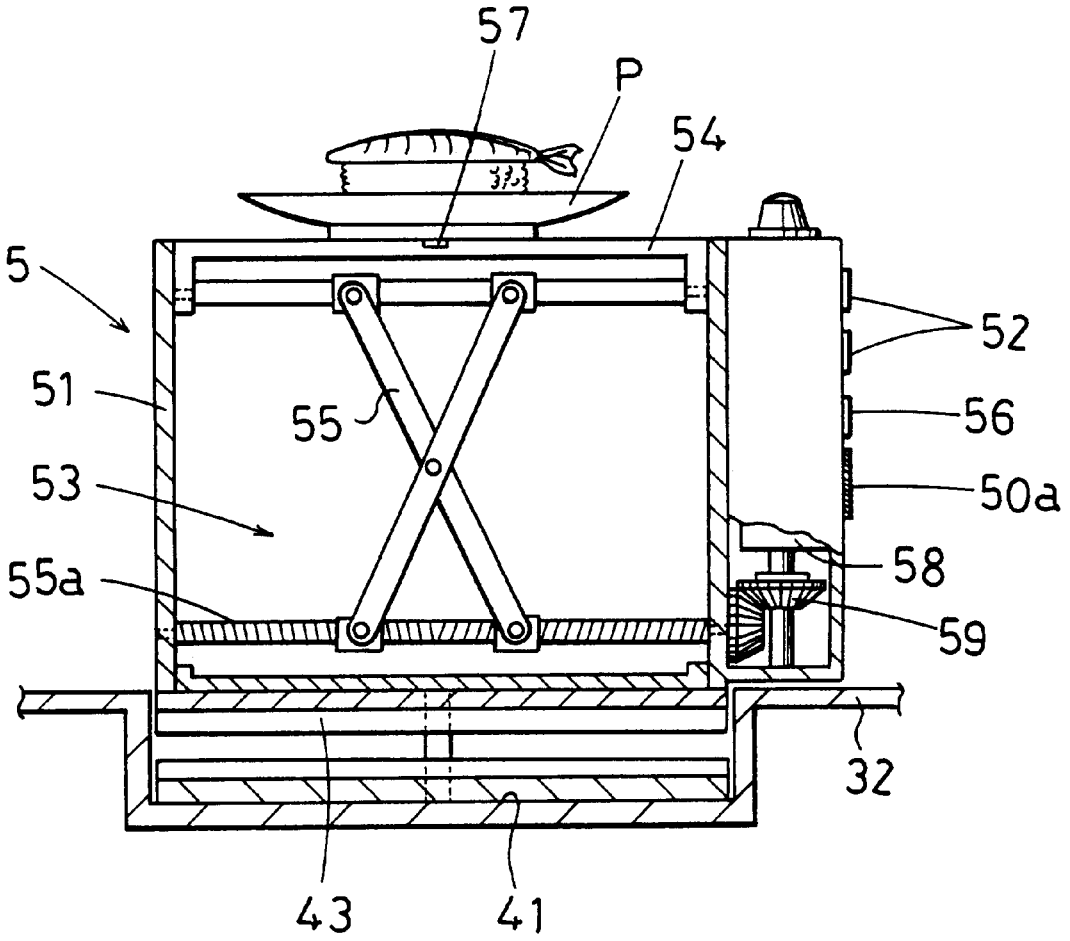
FIG. 6 is a sectional view showing the state in which the dish is exposed from the retracting portion of the conveying container of FIG. 5.
Figure 7:
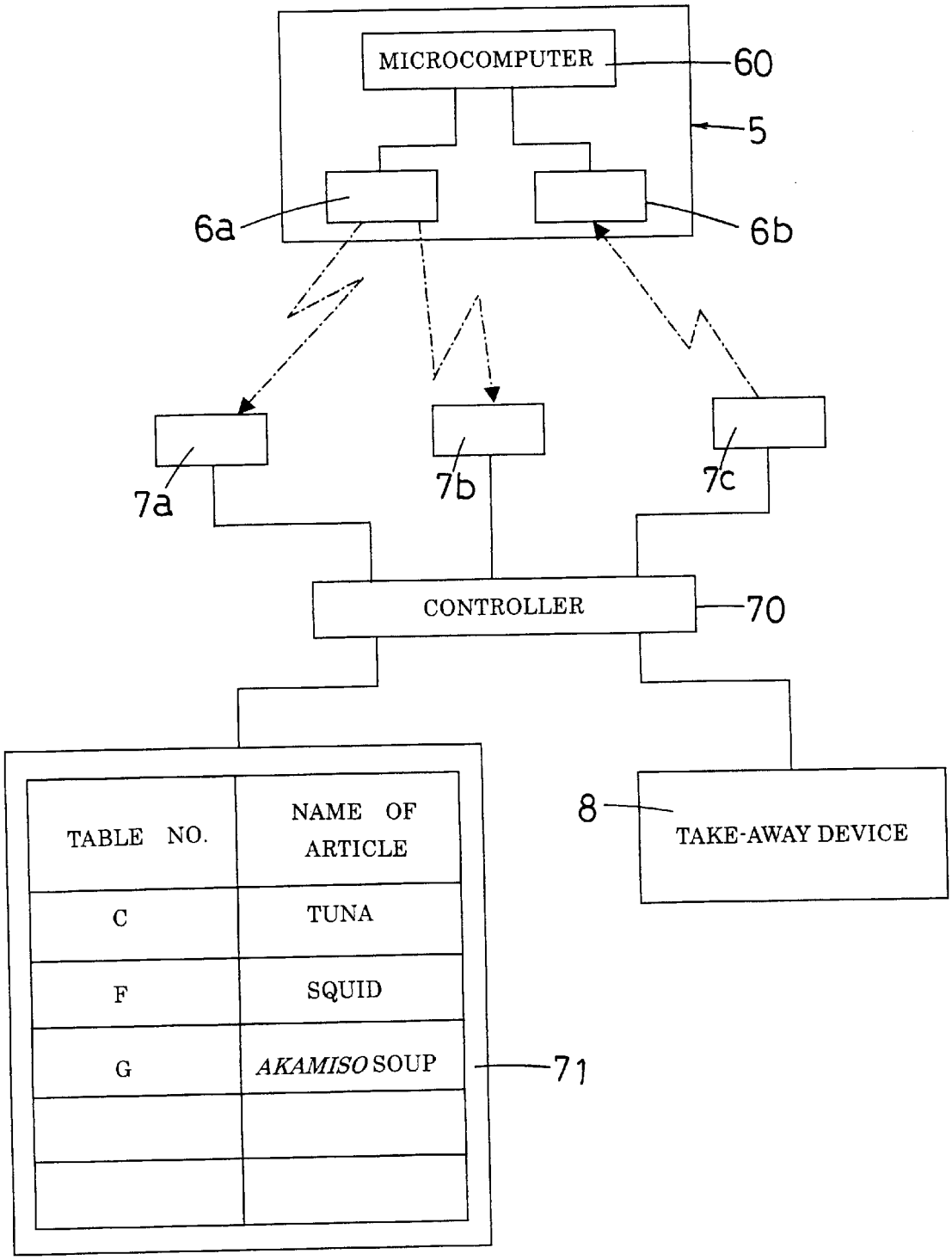
FIG. 7 is a block diagram of the food and drink conveying system of the invention.

Specifically, the conveying container 5 includes, as shown in FIGS. 4 to 6, a box-like casing 51 opening at the top and having, at a side surface thereof, a plurality of press button switches 52 used as input means. The press button switches are marked corresponding to the tables marked with (A), (B), (C), (D), (E), (F), (G), (H), (I) and (J) so that the press button switch 52 having the mark corresponding to the orderer's table can be pressed to enter the designated table's mark.

The casing 51 has, in its interior, a retracting portion 53 that is so designed as to keep a plate P retracted in it before a notice is given by the speaker 50*a* and the lamp 50*b* and also expose the plate P from it so that the plate can be taken after the notice starts to be given by the speaker 50*a* and the lamp 50*b*.

The retracting portion 53 is provided with a lift 55 having a loading member 54 for loading the plate P thereon. When the plate P is loaded on the lift 55 in the kitchen 1B, the lift is in its highest level, as shown in FIG. 6. When a reset button switch 56 provided in the casing 51 is pressed to trigger the reset, the lift is lowered so that the plate P can completely be retracted into the retracting portion 53, as shown in FIG. 5.

The loading member 54 is provided at its top with a sensor 57 used as a food and drink detecting means for detecting the presence of the food and drink on the loading member 54. Also, the casing 51 is provided, at opposite ends thereof, with a conveying-container-side transmitter 6*a* for sending out information output from the button switches 52 and sensor 57 and a conveying-container-side receiver 6*b* for receiving the given information, respectively. Further, a microcomputer 60 is loaded in the bottom of the casing 51 as an operation control means.

The casing 51 is provided, on its front side, with the speaker 50*a* and the lamp 50*b*. When the conveying container 5 containing the ordered good therein comes near the orderer's table, the signals specific for that table sent out from a conveying-path-side transmitter 7*c* as mentioned later are received by the conveying-container-side receiver 6*b*. Then, under the control of the microcomputer 60 loaded in the casing 51, an announcement of the arrival of the order is made through the speaker 50*a*, together with a notice is given through the lightening or flashing of the lamp 50*b*, and also the lift 55 is raised up to the highest level to expose the plate P from the retracting portion 53.

The elevating motion of the lift 55 is effected by driving a motor 58 provided at a lateral side of the casing 51 to rotate a driving shaft 55*a* of the lift 55 via a bevel gear 59 driven in association with the motor 58. The lift 55 is raised by the drive of the motor 58 so that the plate P can be exposed at the same time as the announcement and notice given by the speaker 50*a* and the lamp 50*b* are started. The lift 55 is lowered by the reverse drive of the motor 58 at the push of the reset button switch 56.

The operation of the sensor 57 is checked by the microcomputer 60 within a specified time (e.g. with in 18 seconds) from the start of the announcement of the arrival of the ordered goods, in other words, within the time required for the conveying container 5 to pass past the orderer's table from the start of the announcement of the arrival of the ordered goods.

A circulating conveying path 40 side of the food and drink conveying system is provided with a pair of first and second conveying-path-side receivers 7*a*, 7*b* for receiving output signals from the conveying-container-side transmitter 6*a*, conveying-path-side transmitters 7*c* for sending specific signals associated with the respective tables to the conveying-container-side receiver 6*b*, a controller 70 comprising the microcomputer for controlling the conveying-path-side receivers 7*a*, 7*b* and the conveying-path-side transmitters 7*c*, and a liquid crystal monitor 71 used as a display means for displaying various kinds of information. Within a specified time after a conveying container 5 containing a food or drink therein has arrived at the table having the table number associated with the number entered from the button switch 52, the information, detected by the sensor 57, on the presence of the food or drink to be taken out from the conveying container 5 is sent out from the conveying-container-side transmitter 6*a* to the conveying-path-side receiver 7*b* and the information is displayed on the liquid crystal monitor 71 set in the kitchen 1B under the control of the controller 70.

The first conveying-path-side receiver 7*a* is disposed at or around a boundary between the first housing portion 3*a* and the second housing portion 3*b*. The second conveying-path-side receiver 7*b* is disposed at or around a boundary between the first housing portion 3*a* and the third housing portion 3*b*. The conveying-path-side transmitters 7*c* are disposed at the respective tables 1*a*, 1*b* to output the information signals on the table numbers associated with the respective tables.

The sending and receiving of the signals between the transmitters and their respective receivers is performed by use of infrared light.

In the above-illustrated embodiment, there is provided a take-away device 8 for taking away a conveying container 5 empty of the food or drink from the circulating conveying path 40.

Figure 3:
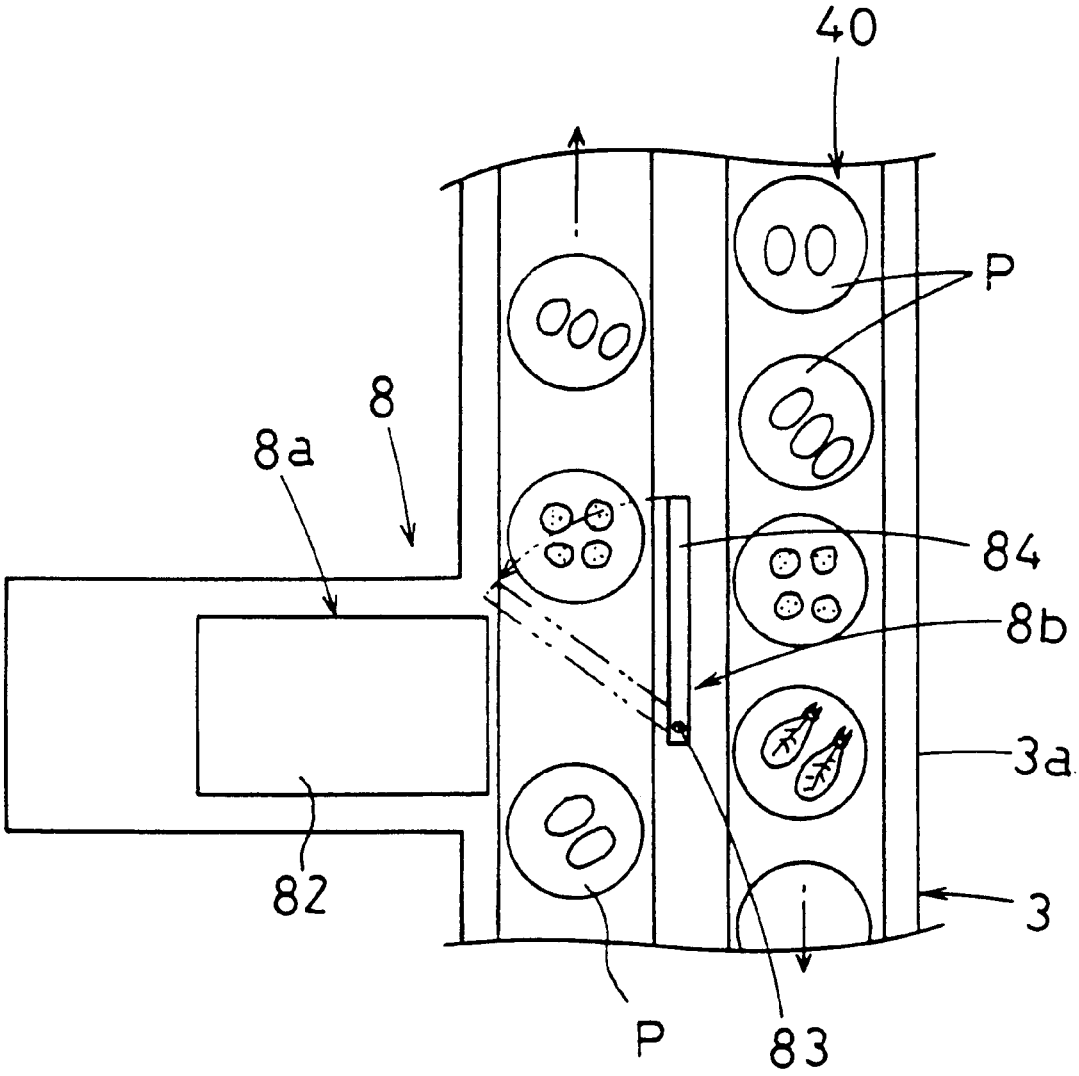
FIG. 3 is an enlarged plan view of a principal part of the food and drink conveying system.

As schematically illustrated in FIG. 3, the take-away device 8 comprises (i) a take-away path 8*a* formed by an endless conveyor belt 82 running between a pair of driving rollers 81 driven by a motor and (ii) a shifting device 8*b* for shifting the emptied conveying container 5 from on the circulating conveying path 40 to the take-away path 8*a*. The conveying container 5 shifted to the take-away path 8*a* by the shifting device 8*b* is returned to the kitchen 1B through the conveyor belt 82.

As schematically illustrated in FIG. 2, the shifting device 8*b* has a pivot shaft 83 that is mounted to be pivotable with respect to the top wall 32, a guide member 84, one lengthwise end portion of which is fixed to an upper end portion of the pivot shaft 83, and a driving device 85, such as a motor, fixedly mounted on a lower end portion of the pivot shaft 83. The driving device 85 is connected to an output side of the controller 70 so that the guide member 84 can be pivoted across the circulating conveying path 40 under the control of the drive of the driving device 85 by the controller 70, as shown by a two-dot dashed line in FIG. 3, to shift the conveying container 5 from the conveying path 40 to the take-away path 8*a*.

With this constructed food and drink conveying system, when a food (e.g. sushi) is ordered from a customer, the table number of the orderer and the sort of ordered goods are input to the controller 70, first. Then, the ordered sushi is dished up on the plate P in the kitchen 1B. After the plate P is put on the loading member 54 of the conveying container 5, it is retracted in the retracting portion 53 at the push of the reset button switch 56.

Subsequently, after the press button switch 52 associated with the table number of the orderer is pressed to input the designated table number, the conveying container 5 is put on the flat chain 43 of the circulating conveying path 40 to convey it into the dinning area 1A together with other plates P put on the flat chain 43 directly.

When the conveying container 5 placed on the circulating conveying path 40 passes through the installation location of the first conveying-path-side receiver 7*a*, the signals sent out from the conveying-container-side transmitter 6*a* are received by the first conveying-path-side receiver 7*a* and are fed back into the controller 70. After that data is collated with the input data on the table number and the ordered goods, the table number and the sort of the ordered goods are displayed on the monitor 71 set in the kitchen 1B under the control of the controller 70.

When the conveying container 5 comes near the orderer's table, the signals specific for that table sent out from the conveying-path-side transmitter 7*c* disposed near that table are received by the conveying-container-side receiver 6*b*. Then, under the control of the microcomputer 60, the announcement made through the speaker 50*a* and the lightening or flashing of the lamp 50*b* are started and concurrently the lift 55 is raised by the drive of the motor 58 to expose the plate P from the retracting portion 53, thus enabling the orderer to surely know the arrival of his/her order.

In the case where the orderer duly takes out the ordered goods from the conveying container 5 and the sensor 57 is operated, the signals indicating that the ordered goods is duly taken out from the conveying container 5 are sent out to the controller 70 through the first conveying-path-side receiver 7*a* at a point in time when the conveying container 5 passes through the installation location of the second conveying-path-side receiver 7*b*. Along with this, under the control of the controller 70, the indication of the orderer's table number and the ordered goods is deleted from the liquid crystal monitor 71; the driving device 85 forming the shifting device 8*b* is driven so that the guide member 84 can be swung to a position crossing the conveying path 40; and the conveyor belt 82 forming the take-away path 8*a* is driven so that the emptied conveying container 5 can be shifted from the circulating conveying path 40 to the take-away path 8*a* by the guide member 84 to be withdrawn into the kitchen 1B through the take-away path 8*a*.

On the other hand, in the case where the orderer neglects to take out the ordered goods from the conveying container 5, the sensor 57 does not operate even after passage of a specified time after the announcement made through the speaker 50*a* and the lightening or flashing of the lamp 50*b* were started. In this case, i.e., in the case where the sensor 57 does not operate even after the passage of a specified time, the lift 55 is lowered via the motor 58 under the control of the microcomputer 60 so that the plate P can be retracted into the retracting portion 53.

When the conveying container 5 comes near the second conveying-path-side receiver 7*b*, the signals indicating that the ordered goods was not taken out from the conveying container 5 are sent out to the controller 70 through the first conveying-path-side receiver 7*a*. Along with this, the conveying container that was not taken out is placed on the circulating conveying path as it is and is conveyed again toward the orderer's table.

Thus, with the food and drink conveying system thus constructed, confirmation and management on whether the ordered goods arrived at the orderer's table can be made in the kitchen 1B.

While the speaker 50*a* to make the announcement and the lamp 50*b* to give the flashing notice are both used as the guide means in the above-illustrated embodiment, either of them may be selectively used.

Also, while the retracting portion 53 capable to move up and down is loaded in the casing 51 forming the conveying container 5 in the above-illustrated embodiment, the retracting portion 53 is not necessarily needed.

What is claimed is:

1. A food and drink conveying system comprising:

a circulating conveying path for food and drink;

a plurality of tables arranged along the conveying path;

a conveying container to contain an ordered food or drink therein and to be placed on the circulating conveying path; and a guide means for giving an orderer a notice of an arrival of his/her order contained in the conveying container, wherein a conveying container side of the food and drink conveying system comprises an input means for inputting a specified table number, a food and drink detecting means for detecting presence of the food and drink in the container, a conveying-container-side transmitter for sending out information that is output from the input means and the food and drink detecting means, a conveying-container-side receiver for receiving specified information, and an operation control means for controlling operation of the guide means on the basis of the input from the input means, while on the other hand, a conveying path side of the food and drink conveying system comprises a conveying-path-side receiver for receiving signals output from the conveying-container-side transmitter, a conveying-path-side transmitter for sending out signals associated with the respective tables to the conveying-container-side receiver, a controller for controlling the conveying-path-side receiver and the conveying-path-side transmitter, and a display means for displaying a variety of information, so that, after the conveying container containing the food or drink therein arrived at a specified table having the table number input by the input means, the information, detected by the detecting means, on the presence of the food or drink to be taken out from the conveying container is sent out from the conveying-container-side transmitter to the conveying-path-side receiver to display the information on the display means through the controller.

2. The food and drink conveying system according to claim 1, wherein there is provided a take-away device for the conveying container from which the food or drink was taken out to be taken away from the circulating conveying path.

3. The food and drink conveying system according to claim 1, wherein the sending and receiving of the signals between the transmitters and their respective receivers is performed by use of infrared light.

4. The food and drink conveying system according to claim 2, wherein the sending and receiving of the signals between the transmitters and their respective receivers is performed by use of infrared light.

* * * * *